2/11/86 XE 4,569,761

United States Patent [19]

Spiewok et al.

[11] Patent Number: 4,569,761

[45] **Date of Patent: * Feb. 11, 1986**

[54] CENTRIFUGE SIEVE AND METHOD OF PRODUCING THE SAME

[75] Inventors: Leonhard Spiewok, Wallisellen; József Fényes, Dietikon, both of Switzerland

[73] Assignee: Sulzer-Escher Wyss AG, Zürich, Switzerland

[ * ] Notice: The portion of the term of this patent subsequent to Feb. 7, 2001 has been disclaimed.

[21] Appl. No.: 531,027

[22] Filed: Sep. 12, 1983

[30] Foreign Application Priority Data

Sep. 27, 1982 [CH] Switzerland ..... 5675/82

[51] Int. Cl.[4] ..... B04B 3/00

[52] U.S. Cl. ..... 210/380.1; 209/406; 210/541

[58] Field of Search ..... 210/380.1, 380.3, 541, 210/360.1; 209/406, 541

[56] References Cited

U.S. PATENT DOCUMENTS 4,430,221 2/1984 Spiewok ..... 210/380.1

FOREIGN PATENT DOCUMENTS 2033242 5/1980 United Kingdom ..... 210/380.1

OTHER PUBLICATIONS

Websters New World Dictionary World Pub. Co., "Dovetail", 1966.

*Primary Examiner*—John Adee

*Attorney, Agent, or Firm*—Werner W. Kleeman

[57] ABSTRACT

In a centrifuge sieve drum, wherein the inner surface of the drum is lined with a support arrangement carrying wear-resistant sieve or screen rods, there is obtained a compensation of the different thermal expansions of the sieve rods and the support arrangement in that, the sieve rods comprise an axially extending web and the support arrangement comprises identically shaped grooves or slots engaged by the webs. Each web and its associated groove or slot may be designed, for example, as a dovetail guide. Thus, while the sieve rods may expand or contract in longitudinal direction or in the direction of the lengthwise axis of the drum, the sieve rods are, however, immovable in radial direction and in circumferential direction. Such a support arrangement can be efficiently manufactured by simultaneously cutting, such as by milling the grooves or slots and sieve openings or slots in a convex outer surface using a triple cutter, such as a milling cutter, and by subsequently bending the supporting arrangement to form a concave surface and inserting the same into the drum.

19 Claims, 12 Drawing Figures

CENTRIFUGE SIEVE AND METHOD OF PRODUCING THE SAME

CROSS-REFERENCE TO RELATED APPLICATION

This application is related to the commonly assigned, copending U.S. application Ser. No. 06/395,142, filed July 6, 1982, and entitled: "Centrifuge Sieve", now U.S. Pat. No. 4,430,221, granted Feb. 7, 1984.

BACKGROUND OF THE INVENTION

The present invention relates to a new and improved construction of a centrifuge sieve or screen which is provided at the inner surface or wall of a centrifuge drum with a support arrangement supporting sieve or screen rods which are formed of a wear-resistant material and extend in the axial direction of the centrifuge drum. The present invention also relates to a new and improved method of manufacturing a centrifuge sieve or screen of this type.

With such type of centrifuge sieves or screens, which are known to the art, for instance from U.S. Pat. No. 4,313,992, granted Feb. 2, 1982 or U.S. Pat. No. 4,259,136, granted Mar. 31, 1981, the sieve or screen rods which protect the centrifuge drum against wear are mounted by adhesive bonds to the support arrangement of the centrifuge drum. For the purpose of compensating for the different thermal expansions of the sieve or screen rods and the support arrangement which are composed of materials having different coefficients of thermal expansion, there are provided for the connections elastic intermediate layers, for example, rubber intermediate elements. However, during operation such elastic intermediate elements do not possess a sufficient service life. Additionally, they allow for a mobility in a number of directions, resulting in undesired and impermissible deformations of the sieve or screen rods and the support arrangement with respect to one another. Additionally, what is further disadvantageous with this equipment design, is the difficult assembly of the sieve or screen rods on the inside of the centrifuge drum or, respectively, the support arrangement, something which is particularly unsuitable for mass production.

Another construction of centrifuge as known, for example, from U.S. Pat. No. 3,100,746, granted Aug. 13, 1963, possesses similar disadvantages. Here the sieve or screen rods loosely rest in a groove at least at one end thereof. Also in this case there is thus possible an uncontrolled mobility and deformation of the sieve or screen rods. Additionally, operation of the centrifuge is only possible with its lengthwise axis oriented in vertical direction and only by using a conical design of the centrifuge drum, in order to prevent the sieve or screen rods from falling out.

In another suggestion for a centrifuge sieve as known, for example, from European Patent Publication No. 71,012, published Feb. 9, 1983 and the aforementioned cognate copending U.S. application Ser. No. 06/395,142, now U.S. Pat. No. 4,430,221, the sieve or screen rods are fixedly connected to the support arrangement only at one place or location while they are connected thereto at other places or locations by means of, for example, slots so as to be movable in axial direction. This suggestion also has certain disadvantages; specifically, the exchange of defective or worn-out sieve or screen rods is troublesome and the manufacture of such a centrifuge sieve is complicated and associated with a great deal of work.

SUMMARY OF THE INVENTION

Therefore, with the foregoing in mind it is a primary object of the present invention to provide a new and improved construction of a centrifuge sieve or screen which is not associated with the aforementioned drawbacks and limitations of the prior art.

Another and more specific object of the present invention aims at providing an improved centrifuge sieve or screen in which the sieve or screen rods possess a relatively long service life, are temperature and corrosion resistant, can be moved in a defined manner relative to the support arrangement, and can be positively connected and readily assembled therewith.

Still a further significant object of the present invention is directed to a new and improved construction of a centrifuge sieve or screen in which the sieve or screen rods can be readily exchanged without restricting the mode of operation and the shape of the centrifuge sieve or screen.

Another important object of the present invention is directed to a new and improved method of manufacturing such a centrifuge sieve or drum which is simple and favorable in respect of costs and also permits mass production.

Now in order to implement these and still further objects of the invention, which will become more readily apparent as the description proceeds, the centrifuge sieve or screen of the present development is manifested by the features that, selectively either the arrangement of the sieve or screen rods or the support arrangement comprise webs interengaging with complementary shaped grooves or slots formed in the other arrangement, so that the sieve or screen rods are only permitted to move in axial direction relative to the support arrangement.

A particularly advantageous solution results when the sieve or screen rods at their contact or bearing surface with respect to the support arrangement comprise dovetails extending in axial direction of the centrifuge drum and the support arrangement comprises slots in the shape of a geometrically corresponding or complementary dovetail guide.

As alluded to above, the invention is not only concerned with the aforementioned apparatus aspects, but also relates to a novel method of manufacturing the inventive centrifuge sieve or screen. Generally speaking, the inventive method relates to manufacturing a centrifuge sieve including a centrifuge drum having an inner surface, a support arrangement provided at the inner surface, sieve rods formed of a wear-resistant material and mounted at the support arrangement so as to extend in the axial direction of the centrifuge drum by means of webs which interengage with substantially complementary shaped grooves formed in the support arrangement.

To achieve the aforementioned measures the inventive method for manufacturing the centrifuge sieve or screen, in its more specific aspects, comprises the steps of:

cutting into the starting material for the support arrangement which is bent to form a convex surface, inclined slots extending outside of the lengthwise axis of the bent starting material and having substantially parallel side walls;

cutting further inclined slots with substantially parallel side walls into the aforementioned inclined slots at an opposite inclination relative to the lengthwise axis; and subsequently bending the support arrangement to form a concave surface corresponding to the inner surface of the centrifuge drum.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the centrifuge sieve or screen has been shown as needed for those skilled in the art to readily understand the underlying principles and concepts of the present development, while simplifying the showing of the drawings.

Figure 1:
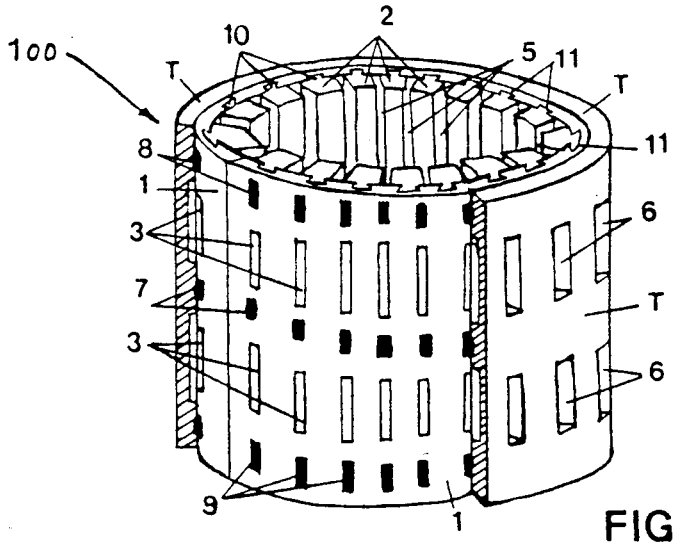
FIG. 1 is a perspective view of a first exemplary embodiment of a centrifuge sieve or screen constructed according to the invention.
Figure 2:
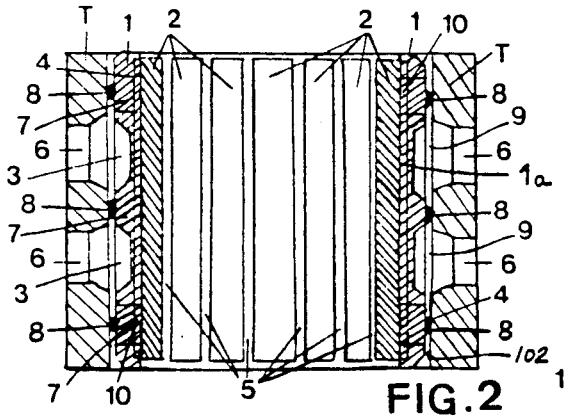
FIG. 2 is an axial section through the centrifuge sieve shown in FIG. 1.
Figure 3:
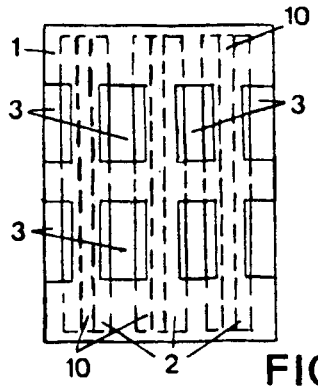
FIG. 3 is a detailed section showing part of the outer wall of the centrifuge drum of the centrifuge sieve shown in FIG. 1.

Turning attention now specifically to FIGS. 1, 2 and 3, there has been illustrated therein a first exemplary embodiment of centrifuge sieve or screen 100 comprising a centrifuge drum T possessing a drum diameter in the decimeter up to the meter range. At the inner surface or wall 102 of the centrifuge drum T there bears a sieve or screen-like support arrangement 1. At the inner surface or wall 1*a* of this support arrangement 1 there are mounted, in the axial direction of the centrifuge drum T at a slight lateral spacing from each other, a multiplicity of sieve or screen rods 2 which likewise provide wear protection. These sieve or screen rods 2 are formed of a hard material or any other suitable material and possess a thickness of several millimeters and a length amounting up to 30 cm.

The support arrangement 1 is constructed from a suitable metal, for instance steel, and possesses sieve or screen slots or openings 3 or equivalent passages for the throughflow of the filtrate during centrifuging. Instead, however, the support arrangement 1 may also consist of a framework of rings or ring members which are interconnected by axially parallel extending rods, so that there are formed between the rods the required sieve or screen slots or the like. At the inner surface or wall 102 of the centrifuge drum there are provided substantially ring-shaped webs 4 upon which bears the support arrangement 1. The latter may also contain at the outside thereof ring-shaped webs 7 and possibly may bear upon spacers or spacer members 8 or equivalent structure. A throughpassage for the filtrate is formed by the intermediate spaces 5 between the sieve or screen rods 2, the slots 3 of the support arrangement 1 located therebelow, the intermediate space 9 between the support arrangement 1 and the centrifuge drum T as well as by the slots or openings 6 in the centrifuge drum T which are offset with respect to the intermediate spaces 5 between the sieve or screen rods 2. In case of slots which are not or only slightly offset from each other the spacers or spacer members 8 may be dispensed with.

The sieve or screen rods 2 may be formed of a suitable wear-resistant hard material, for example, cast basalt or sintered material, such as sintered ceramics or sintered carbide, for example alumina or tungsten carbide. Under somewhat less strict requirements, a suitable wear-resistant steel may serve as the sieve or screen rod material, as may an especially wear-resistant plastics material which is reinforced, for example, by glass fibers or carbon fibers, or any other suitable wear-resistant material. Since during operation of the centrifuge there can arise temperature fluctuations up to 100° C., it is necessary because of the markedly different thermal expansions of the materials, for example, tungsten carbide, from which the sieve or screen rods 2 may be formed and, for example, steel from which the support arrangement 1 may be formed, to undertake measures for enabling a length compensation when the sieve or screen rods 2 are mounted to the support arrangement 1, in order to avoid deformations and fracture or rupture of the sieve or screen rods 2. For this purpose, dovetail-shaped webs 10 are provided at the contact or bearing surfaces of the sieve or screen rods 2 which interengage with corresponding identically or complementary shaped grooves or slots 11 formed in the support arrangement 1, so that complementary shaped interengaging connecting means are formed at the sieve or screen rods 2 and the support arrangement 1.

The arrangement and guiding of the sieve or screen rods 2 as described hereinbefore causes the sieve or screen rods 2, while being immovable in radial direction, to be movable, however, in longitudinal direction, i.e. in the axial direction of the centrifuge drum T, so that there is possible a length compensation. Due to the axial alignment or extent of the grooves or slots 11 movement in circumferential direction is made impossible.

By virtue of the described arrangement there is achieved a defined mobility of the sieve or screen rods 2 with respect to the support arrangement 1 only in the primary or main direction of expansion, i.e. in the longitudinal direction of the sieve or screen rods 2. Specifically, this defined mobility is accomplished by using extremely durable or strong materials only, which are resistant to temperature and corrosion. In comparison to known centrifuge sieves or screens in which elastic rubber or plastics connection elements are employed, it is possible with the described arrangement, during practical operation, to enhance the service life by a multiple and to appreciably improve the corrosion resistance. A further advantage is constituted by the significantly easier exchangeability of the sieve or screen rods 2, since the webs 10 thereof only have to be introduced into the corresponding dovetail guides formed by the grooves or slots 11 and since sieve or screen rods 2 in the incipient state of rupture are retained over their entire length due to the special design of the guide means therefor.

Figure 4:
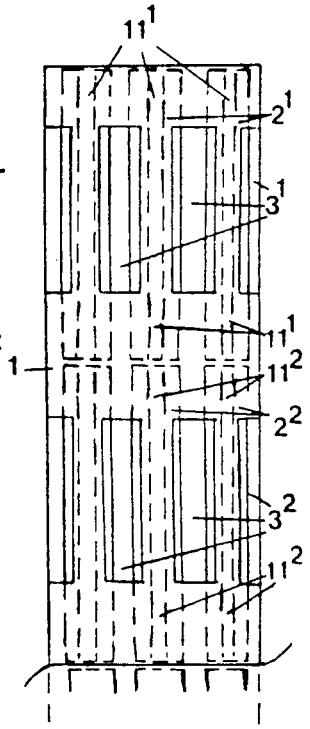
FIG. 4 illustrates a detail of the outer wall of the centrifuge drum according to a second embodiment of the centrifuge sieve according to the invention.

A second embodiment of the centrifuge sieve or screen is illustrated in FIG. 4. Here a multiple number of sets of sieve or screen rods $2^1$, $2^2$ are arranged in series or succession in slight spaced relationship in axial direction. Again, the interconnection of the sieve or screen rods $2^1$ and $2^2$ and the support arrangement 1 is effected by means of complementary shaped interconnecting means, namely webs and slots $11^1$ and $11^2$ which, for example, may be designed as a dovetail guide arrangement. A number of rows of sieve or screen slots $3^1$ and $3^2$ are provided intermediate the sieve or screen rods $2^1$ and $2^2$ in the support arrangement 1 through which the filtrate may flow out. In comparison to the first exemplary embodiment there may be obtained a greater length of the centrifuge drum T which may extend up to several meters by using a multiple number of sets of sieve or screen rods 2. This is of advantage especially in the case of sintered materials which only permit fabrication of limited rod lengths. In this exemplary embodiment the support arrangement 1 also can be composed of a multiple number of members arranged in series in axial direction. In such a case each member of the support arrangement 1 may carry, for example, only one set or layer of sieve or screen rods 2; however, it is also readily possible to provide a number of sets or layers, for instance two sets or layers, in which case the sieve or screen rods 2 may be inserted into the slots from both sides or ends thereof.

It may be noted that instead of providing a support arrangement 1 which is separate from the centrifuge drum T the same may also be fixedly connected therewith. Also, the inner portion or side of the centrifuge drum T may serve as the support arrangement upon which the sieve or screen rods 2 directly bear and which is provided with the required grooves or slots 11.

In FIGS. 5 to 9 there are illustrated in respective partial or fragmentary sectional views various advantageous geometrical shapes of complementary shaped interengaging connecting means which basically form webs 10 and grooves or slots 11 for interconnecting the sieve or screen rods 2 and the supporting arrangement 1.

Figure 5:
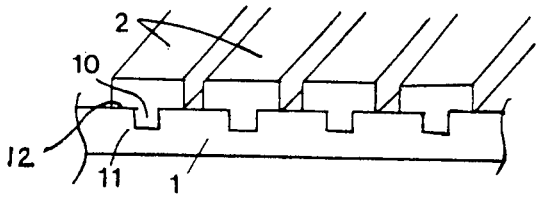
FIG. 5 is a fragmentary perspective view of a first design for the interconnection of the arrangement of sieve or screen rods and the support arrangement in the centrifuge sieve as shown in either FIG. 1 or FIG. 4.

In a first design of the interconnecting or connecting means as shown in FIG. 5 the sieve or screen rods 2 form a bearing or contact surface 12 by means of which these sieve or screen rods 2 bear upon the related support arrangement 1. At the bearing or contact surface 12 the sieve or screen rods 2 are provided with webs 10 of a substantially rectangular cross-sectional shape which extend in axial direction. Correspondingly configured grooves or slots 11 are provided in the support arrangement 1 and the webs 10 are precisely fitted thereto and may be clamped therein, if desired.

Figure 6:
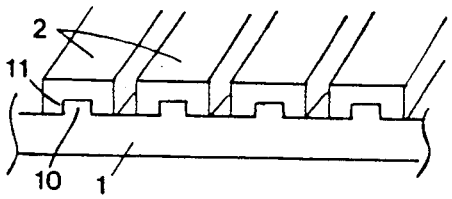
FIG. 6 is a fragmentary perspective view of a second design for the interconnection of the arrangement of sieve or screen rods and the support arrangement in the centrifuge sieve as shown in either FIG. 1 or FIG. 4.

In a second design as shown in FIG. 6 the interconnecting or connecting means are of a reverse configuration or arrangement in that here the webs 10 are now provided at the supporting arrangement 1 while the sieve or screen rods 2 are provided with corresponding or complementary grooves or slots 11.

Figure 7:
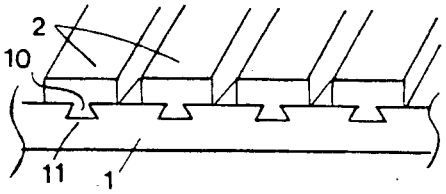
FIG. 7 is a fragmentary perspective view of a third design for the interconnection of the arrangement of sieve or screen rods and the support arrangement in the centrifuge sieve as shown in either FIG. 1 or FIG. 4.

A third design of the interconnecting or connecting means is shown in FIG. 7 and here the cross-section of the webs 10 and of the grooves or slots 11 is conveniently selected to be of a substantially trapezoidal shape, i.e. in the shape of a dovetail guide, in order to prevent dropping out of the sieve or screen rods 2, something which is possible in the case of a rectangular cross-section of the webs 10 when the close dimensional tolerances required therefor are not exactly maintained.

Figure 8:
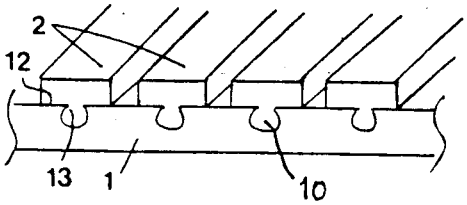
FIG. 8 is a fragmentary perspective view of a fourth design for the interconnection of the arrangement of sieve or screen rods and the support arrangement in the centrifuge sieve as shown in either FIG. 1 or FIG. 4.

Protection against unintentional dropping out of the sieve or screen rods 2, however, is also possible by using other geometric designs or shapes of the interconnecting or connecting means as, for example, shown by the fourth design depicted in FIG. 8. As shown therein, the webs 10 are of a rounded shape with a constriction 13 provided close to the bearing or contact surface 12, the groove or slot 11 being correspondingly designed with an inwardly directed enlargement.

Figure 9:
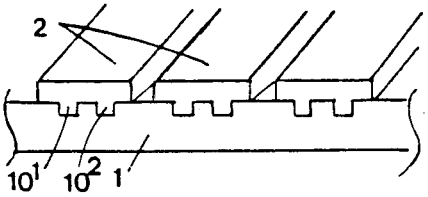
FIG. 9 is a fragmentary perspective view of a fifth design for the interconnection of the arrangement of sieve or screen rods and the support arrangement in the centrifuge sieve as shown in either FIG. 1 or FIG. 4.

A fifth design of the interconnecting or connecting means is shown in FIG. 9 and, accordingly, in this case several substantially parallel extending webs $10^1$ and $10^2$ also can be provided at each one of the sieve or screen rods 2.

Furthermore, the slots may be designed as grooves or the like of limited depth, as shown in the precedingly described exemplary designs, but also may form slots which are throughpassingly extended in depth i.e., continuous or open-ended slots as may be the case, for example, when the supporting arrangement 1 comprises separate rods which at most are interconnected at their ends.

In the exemplary embodiments and designs as described hereinbefore and in possible further variations thereof which are possible within the teachings and scope of the inventive concepts, there is ensured that the sieve or screen rods 2 can practically unobstructedly expand or contract in the direction of the lengthwise axis of the centrifuge drum T, however are immovable with respect to the circumferential and radial directions. Moreover, the assembly and the exchange of the sieve or screen rods 2 is extremely simple.

Figure 10:
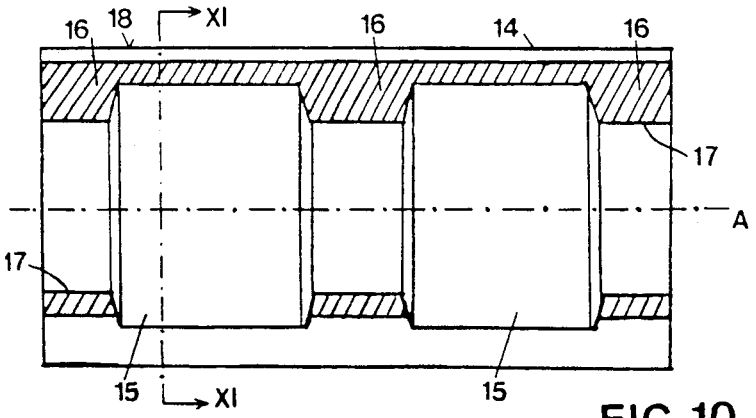
FIG. 10 is a longitudinal sectional view taken substantially along the line X—X in FIG. 11 of the starting material for the support arrangement used for manufacturing the centrifuge sieve as shown in either FIG. 1 or FIG. 4 and serving for explaining a method of manufacturing such centrifuge sieve with a support arrangement of the type shown in FIG. 7.
Figure 11:
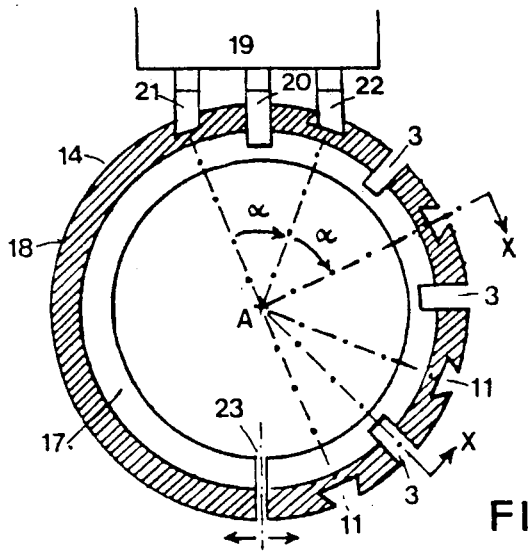
FIG. 11 is a cross-sectional view taken substantially along the line XI—XI in FIG. 10 and illustrates a first embodiment of a manufacturing method by which the connection means of the support arrangement as shown in FIG. 7 are produced in the starting material for the support arrangement shown in FIG. 10.
Figure 12:
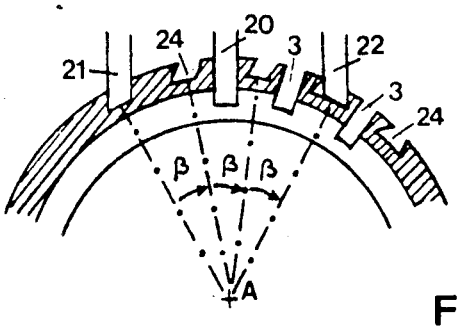
FIG. 12 is a fragmentary sectional view, similar to FIG. 11, and illustrates a second embodiment of the manufacturing method by which the connection means of the support arrangement shown in FIG. 7 are produced.

Basically, the sieve or screen slots or openings 3 and the grooves or slots 11 can be produced in conventional and known manner, as, for example, by using suitable cutting tools, such as milling cutters. However, when the interconnecting or connecting means are designed in the manner of a dovetail guide as shown in FIG. 7, the use of a particularly simple and efficient manufacturing method favorable with respect to costs is made possible. In the manufacturing method just mentioned the material of the supporting arrangement 1 is firstly bent to form a convex surface. Then, by using a milling cutting tool or other suitable cutter applied to the outside of the convexly bent surface, a slot or groove with parallel side walls or flanks is cut into the convex surface. During this operation the direction in which the cutting tool is applied and thus the direction of the flanks extends at an inclination with respect to the lengthwise axis of the supporting arrangement 1, i.e. on one side of the lengthwise axis in a predetermined spaced relationship thereto, as will be also further considered hereinafter with reference to FIGS. 10 to 12. Stated in another way, the flanks or side walls extend at an angle with respect to the radius of the convex surface, for instance formed by a tube, extending between the flanks. After terminating this method step, a cutting tool is applied to the same location at the surface which, however, extends at an opposite inclination with respect to the lengthwise axis, i.e. in a direction of application which extends on the other side of such axis. There is thus cut a further slot at an inclination to the already present slot or groove, so that a dovetail groove 11 is formed. Subsequently, the support arrangement 1 is bent in reverse direction to form a concave surface, the shape of which corresponds to the inside of the centrifuge drum T. The dovetail grooves 11 thus come to lie on the inside of the support arrangement 1.

A particularly advantageous further development of this method can be achieved when the dovetail grooves or slots 11 and the sieve or screen slots 3 are cut in one working operation or in the same method steps. As shown by the sectional illustrations in FIGS. 10 and 11 there is used a tube 14 as the starting material for the support arrangement 1. The diameter of the tube 14 approximately corresponds to the internal diameter of the centrifuge drum T. The tube 14 defines a lengthwise axis A and contains serially arranged or successive alternating sections or zones 15 and 16 of smaller and greater wall thickness, respectively. The sections or zones 16 of greater wall thickness form beads or webs 17 on the inside of the tube 14 while the outside 18 of the tube 14 is smooth and possesses a uniform diameter. The tube 14 is machined on its outside 18 using a milling cutting tool 19 which comprises three parallel milling cutters 20, 21 and 22 as, for example, three circular saw blades or a central circular saw blade 20 and two outer or lateral side-milling cutters 21 and 22. The penetration depth of the central cutter 20 is selected and adjusted such that this cutter 20, when a slot is cut along a shell or surface line of the tube 14, i.e. in axial direction, penetrates the entire tube wall in the sections or zones 15 of smaller wall thickness, so that a slot is formed at these locations which throughpassingly extends from the outside to the inside and later forms a sieve or screen slot 3. Contrary thereto, at the locations or zones 16 of greater wall thickness only a non-throughpassing groove or slot is cut and a continuous ring remains which later forms the ring-shaped web 17. The depth of the two outer or lateral cutters 21 and 22, as compared to the central cutter 20, is selected and adjusted such that during the cutting operation the wall of the tube 14 is not completely penetrated in any of the two sections or zones 15 and 16, so that only grooves or slots are formed.

During the cutting or milling operation the three cutters or milling cutters 20, 21 and 22 are simultaneously operated. While the central cutter or milling tool 20 produces the slots which later will form the sieve or screen slots 3, the outer or lateral cutter or milling tool 21 cuts a groove the side walls of which extend at an inclination with respect to the lengthwise axis A, i.e. at an angle with respect to the radius of the tube 14 extending through the groove. After this operational step the tube 14 is rotated about its lengthwise axis A by an angle $\alpha$ which is selected such that the other outer or lateral cutter 22 is positioned at the location at which the cutter 21 already has formed an inclined groove. During the following working or operating step the cutter or milling tool 22 acts on the groove which already has been precut by the cutter 21 and cuts thereinto a flank which also extends at an inclination with respect to the lengthwise axis, i.e. to the radius of the tube 14 extending through the groove, however, at an opposite inclination. In this way a dovetail groove having a substantially trapezoidal cross-section is formed, while the central cutter 20 simultaneously cuts a further slot and the lateral cutter 21 precuts another groove. Subsequently, the tube 14 is again rotated by the angle $\alpha$ and all the operational or working steps are repeated until the entire surface of the tube 14 is provided with slots 3 and grooves 11. When the cutting operations are finished, the tube 14 is slit at the location designated by reference numeral 23 and is reversibly bent to form a concave surface with opposite curvature. The support arrangement 1 thus formed is inserted into the interior of the centrifuge drum T, so that dovetail grooves 11 are now present at the inside of the support arrangement 1. The sieve or screen rods 2, then, can be introduced into the dovetail grooves or slots 11 either immediately after the cutting operation is terminated or yet after the support arrangement 1 has been bent to assume its final shape, if desired, also only after the support arrangement 1 has been placed into the centrifuge drum T.

Variations of the method are possible within the scope of the inventive concept. Thus, FIG. 12 demonstrates a second embodiment of the method in which the tube 14 is rotated through an angle $\beta$ about its lengthwise axis A between the cutting operations. The angle $\beta$ is selected such that a precut groove 24 is converted to the finished dovetail groove 25 only in the third following operational or working step.

In any case, when using the aforementioned starting material and the method as described hereinbefore, the centrifuge sieve or screen can be extremely simply and efficiently manufactured even in mass production.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A centrifuge sieve comprising:

a centrifuge drum defining an axial direction and having an inner surface;

a support arrangement provided at said inner surface of said centrifuge drum;

sieve rods mounted at said support arrangement and extending in said axial direction of said centrifuge drum;

said sieve rods being formed of a wear-resistant material; and said sieve rods and said support arrangement containing substantially complementary shaped interengaging connecting means permitting movement of said sieve rods relative to said support arrangement only in said axial direction.

2. The centrifuge sieve as defined in claim 1, wherein: said sieve rods define a sieve rod arrangement; and said connecting means comprise webs selectively provided at one of said support arrangement and said sieve rod arrangement and interengaged with substantially complementary shaped grooves provided at the other one of said two arrangements.

3. The centrifuge sieve as defined in claim 2, wherein: said webs are provided at said sieve rod arrangement and said grooves are provided at said support arrangement.

4. The centrifuge sieve as defined in claim 2, wherein: said webs possess a substantially rectangular cross-sectional configuration.

5. The centrifuge sieve as defined in claim 2, wherein: said webs contain a constriction.

6. The centrifuge sieve as defined in claim 2, wherein: said webs contain a substantially trapezoidal cross-section and form conjointly with said grooves a dovetail guide.

7. The centrifuge sieve as defined in claim 2, wherein: said sieve rod arrangement and said support arrangement each comprise a number of interengaging webs and grooves extending substantially parallel to each other.

8. The centrifuge sieve as defined in claim 1, wherein: said sieve rods are formed of a sintered material.

9. The centrifuge sieve as defined in claim 8, wherein: said sintered material is a sintered ceramic.

10. The centrifuge sieve as defined in claim 8, wherein:

said sintered material is a sintered carbide.

11. The centrifuge sieve as defined in claim 10, wherein:

said sintered carbide is tungsten carbide.

12. The centrifuge sieve as defined in claim 8, wherein:

said sintered material is cast basalt.

13. The centrifuge sieve as defined in claim 8, wherein:

said sintered material is alumina.

14. The centrifuge sieve as defined in claim 1, wherein:

said support arrangement supporting said sieve rods is formed by said inner surface of said centrifuge drum.

15. In a method of manufacturing a centrifuge sieve including a centrifuge drum having an inner surface, a support arrangement provided at said inner surface, sieve rods formed of a wear-resistant material and mounted at said support arrangement so as to extend in an axial direction of said centrifuge drum by means of webs having a substantially trapezoidal cross-section which are interengaged with complementary shaped grooves formed in said support arrangement, said method comprising the steps of:

cutting into a starting material for said support arrangement which is bent to form a convex surface inclined grooves extending outside a lengthwise axis of said convex surface and having substantially parallel side walls;

cutting further inclined grooves with substantially parallel side walls and of opposite inclination relative to said lengthwise axis into said inclined grooves; and subsequently bending said support arrangement to form a concave surface corresponding to said inner surface of said centrifuge drum.

16. The method as defined in claim 15, further including the step of:

cutting slots with substantially parallel side walls into said starting material.

17. The method as defined in claim 15, further including the steps of:

using as said starting material for said support arrangement a material comprising sections of alternatingly smaller and greater wall thickness which are successively arranged in the direction of said lengthwise axis defined by said convexly bent starting material;

using a multiple cutter comprising a central cutter and two lateral cutters in order to cut three substantially mutually parallel grooves with substantially parallel side walls into said starting material;

a central one of said grooves extending in axial direction and having a depth sufficient to penetrate the entire thickness of said starting material in said sections of smaller wall thickness and the two outer ones of said grooves extending on different sides of said lengthwise axis and having a depth insufficient to penetrate the entire thickness of said starting material even in said sections of smaller wall thickness;

rotating said starting material about said lengthwise axis by an angle sufficient to place one of said outer grooves cut by one of said lateral cutters at an operating point of the other lateral cutter on the opposite side of said lengthwise axis;

repeating said cutting and rotating steps until the entire surface of said starting material is provided with said grooves; and subsequently bending said starting material such as to form a support arrangement defining a predetermined concave surface.

18. A method of manufacturing a supporting arrangement for a centrifuge drum of a centrifuge sieve, comprising the steps of:

convexly bending a starting material for said support arrangment so as form a shell defining an outer surface and an axial direction and a radial direction;

cutting axially extending grooves with substantially parallel side walls at an inclination relative to said radial direction into said outer shell surface;

further cutting into one of said side walls of said grooves at an opposite inclination relative to said radial direction;

cutting axially and radially extending slots into said shell; and rebending said starting material such that said grooves are positioned at an inner surface thereof in order to form the supporting arrangement.

19. The method as defined in claim 18, further including the steps of:

using as said starting material for said support arrangement a material comprising sections of alternatingly smaller and greater wall thickness which are successively arranged in said axial direction;

using a three-membered cutting tool to simultaneously cut in a first step said slot in said sections of smaller wall thickness and laterally thereof two of said grooves;

turning said shell through an angle essentially corresponding to the angular spacing of said grooves; and repeating said cutting and turning operation until the entire shell is provided with said slots and grooves.

* * * * *